US007707709B2

(12) United States Patent
Whitehead

(10) Patent No.: US 7,707,709 B2
(45) Date of Patent: May 4, 2010

(54) PNEUMATIC BEARING RACE AND PINION RACE DRIVER SET

(75) Inventor: Michael L. Whitehead, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 1183 days.

(21) Appl. No.: 11/294,907

(22) Filed: Dec. 6, 2005

(65) Prior Publication Data

US 2007/0124921 A1 Jun. 7, 2007

(51) Int. Cl.
*B21D 53/10* (2006.01)

(52) U.S. Cl. ..... 29/724; 29/255; 29/256; 29/263; 29/270; 29/275; 29/278; 29/280; 29/281; 29/898.061; 29/898.062

(58) Field of Classification Search ..... 29/255, 29/256, 270, 724, 275, 280, 282, 898.061, 29/898.062, 278, 261–263, 283, 244
See application file for complete search history.

(56) References Cited

U.S. PATENT DOCUMENTS 3,651,553 A * 3/1972 Dodd ..... 29/275

OTHER PUBLICATIONS

Lisle Corporation Website: http://www.lislecorp.com/tool_detail.cfm?detail=56.*
Invention Disclosure Agreement, Submission No. 99-442, Sep. 12, 1996, Jonathan F. Kelley, "Air Hammer Bit to Race Driver Attachment".
Invention Disclosure Agreement, Submission No. 01-346, Sep. 30, 2001, Mike Klos, "Driver Handle".
Lisle Catalog, p. 26, Part Nos. 12600 and 12980, Bearing Race and Seal Driver Sets.

* cited by examiner

*Primary Examiner*—David P Bryant
*Assistant Examiner*—Bayan Salone
(74) *Attorney, Agent, or Firm*—Banner & Witcoff, Ltd.

(57) ABSTRACT

A bearing race and pinion bearing race installation tool kit or set includes a pneumatic and manual driver handles in combination with a multiplicity of separate drivers. The component parts may be selected from the kit, combined and then used for installation of a bearing raceway.

17 Claims, 4 Drawing Sheets

FIG.7
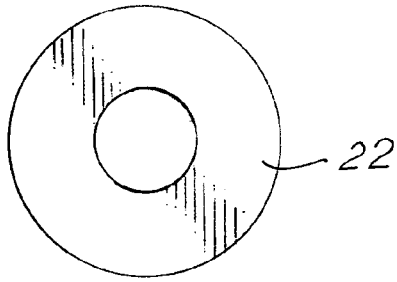
FIG.8
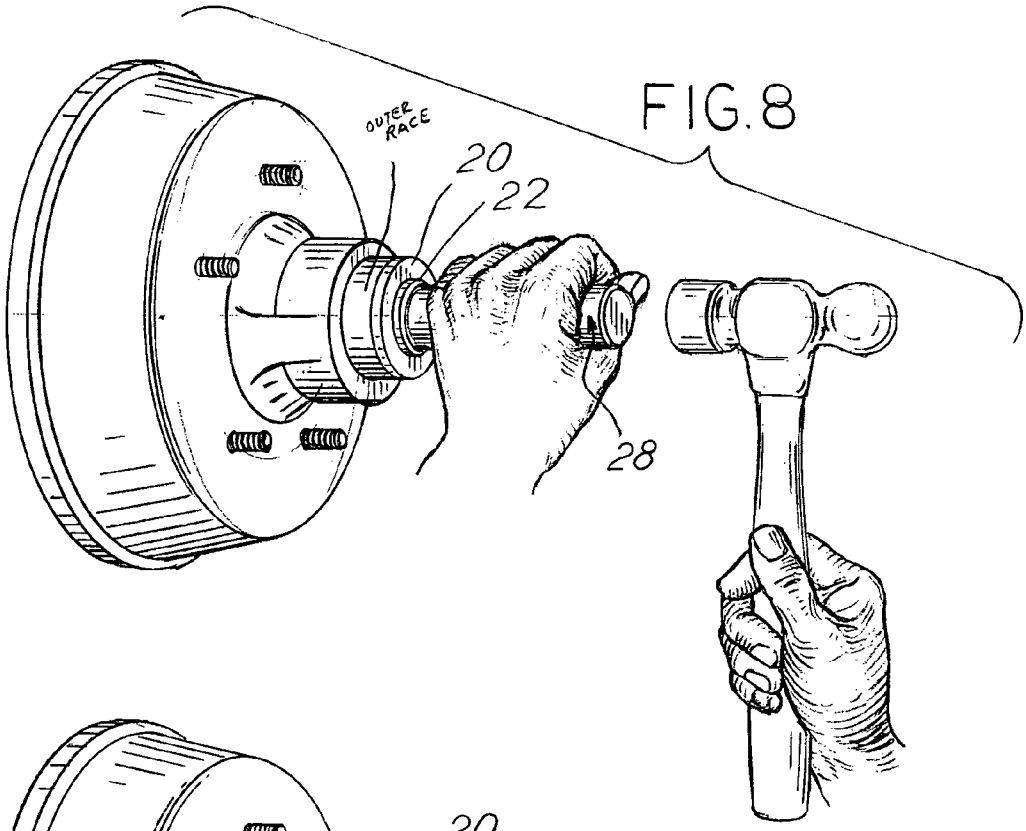
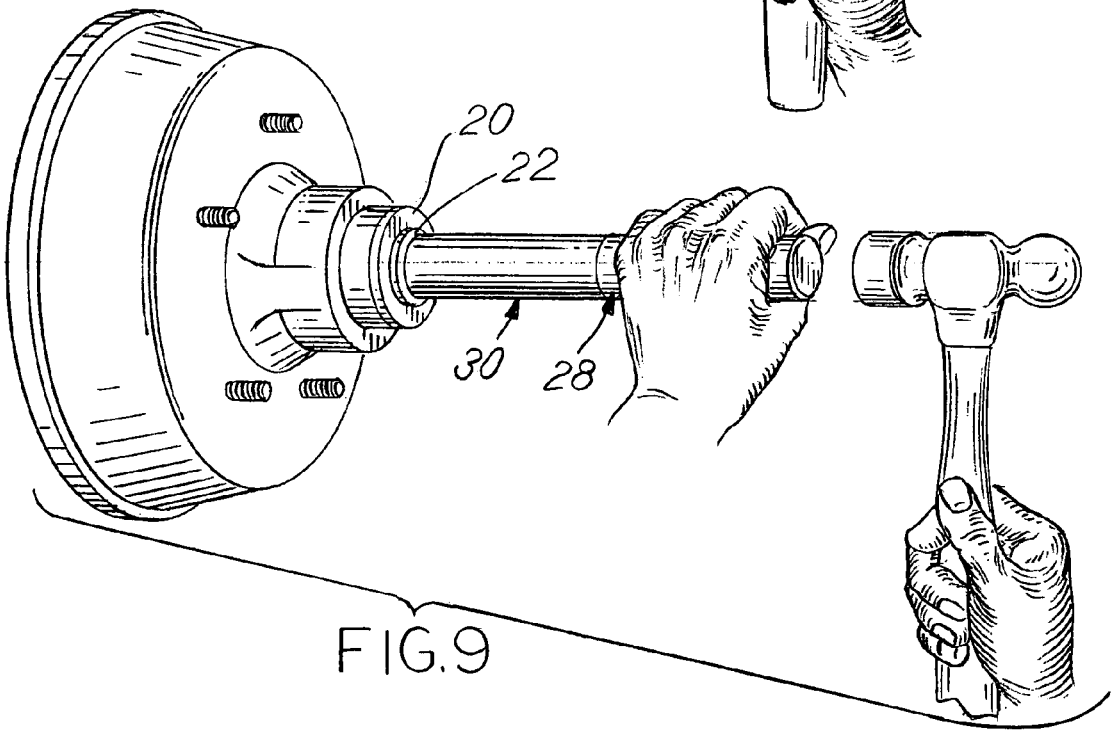
FIG.9

PNEUMATIC BEARING RACE AND PINION RACE DRIVER SET

BACKGROUND OF THE INVENTION

In a principal aspect the present invention relates to a bearing race and seal driver set or kit and a pinion bearing race driver set or kit for installation of bearing races and seals.

Lisle Corporation has, for a number of years, made available an automotive repair tool identified as a Bearing Race and Seal Driver Set. Lisle Corporation makes and sells such sets, identified as Product No. 12600 and No. 12980, which are used for the purpose of inserting a properly aligned bearing race quickly into an axle housing, by way of example. The same tools may be used to install seals in a housing. Tools of this general type are described in U.S. Pat. No. 3,651,553 issued Mar. 28, 1972 for a Bearing Race Driver, which patent is incorporated herewith by reference.

With the continuous development of various vehicle designs and vehicle improvements, such as four-wheel drive and other changes in vehicle construction, the number, variety and construction of bearing races has evolved. Bearing races are now commonly used in transmissions, differentials and other component parts of a vehicle and in many other machines. In certain circumstances, bearing races are larger than previously common place and thus more difficult to position or insert. Thus, tools of the type disclosed in U.S. Pat. No. 3,651,553 and the references cited therein are not always adequate for machine and vehicle repair; namely, replacement or installation of seals and bearing races.

Additionally, quality control of the component parts in vehicles and machines, especially replacement parts, may be deficient necessitating more frequent replacement of parts such as bearing races. For example, a bearing race may not be properly heat treated and, as such, may fail prior to an expected life span. As a consequence, the removal and replacement of bearings, seals and bearing races is a growing repair consideration. Thus, there has developed a need for an improved bearing race driver sets or kits capable of use for a broad range of automotive and machine components including, but not limited to pinion bearing races.

SUMMARY OF THE INVENTION

Briefly, the present invention comprises a set or kit (or sets) of tools for driving or installing bearing races and/or seals. Bearing races are annular and typically have a cylindrical exterior wall that is seated or engaged in a cylindrical counterbore of a particular machine or automotive component such as a wheel hub, differential or the like. Further, such races typically have a frustoconical tapered interior wall which serves as the race or raceway for bearings fitted against the tapered or frustoconically shaped interior wall. A circumferential, planar rim generally extends between the interior wall and the exterior wall of the race, the rim being transverse to and connecting the frustoconical wall to the cylindrical outer walls of the bearing race.

The invention relates to the combination of a number of elements comprising a kit or kits for repair, replacement and insertion of bearing raceways and seals. Each kit typically includes a series of uniquely sized drivers, each driver sized to engage a compatible sized bearing race or seal. Each driver is comprised of a generally cylindrical collar which is coaxial with an integral, frustoconical disc. A uniformly sized axial passage extends through each driver. Typically, the axial passage is substantially of the same size and dimension in each of the drivers. Two or more drivers are typically provided in a kit.

More typically, upwards 10-15 or as many as 18 drivers may be required to facilitate the full range of the application of a tool kit of the invention.

The drivers are each designed to be cooperative with a single, universal sized, generally cylindrical, manual driver handle. For certain applications, such as for pinion bearing races, the effective length of the driver handle may be extended by means of a handle extension positioned between the driver handle and a driver which is attached to the extension.

Alternatively or additionally, a pneumatic driving handle is provided as an alternate driving mechanism for drivers. The alternate pneumatic driver handle includes a forward cylindrical section with a projecting coaxial stud that is designed to fit through the uniformly sized axial passage of each of the drivers. The opposite end of the pneumatic driver handle includes an axial drive rod with a collar against which a pneumatic tool may impinge to effect a driving operation. This arrangement saves significant amounts of time when installing bearing races.

A washer is preferably provided to fit between the connection of a handle (or extension) and a driver to thereby efficiently and effectively spread the force acting on the driver through the handle. A nut or bolt is provided for attachment of the various handles to a driver is provided. The entire array is generally symmetrical about a linear axis extending through the component parts. The component parts are thus designed to be arranged or assembled coaxially.

The use of a pneumatically driven handle in such a kit is highly unique and the configuration and size requirements for such a pneumatic driving handle as well as the materials from which it is made in combination with the materials used for manufacture of the drivers enable broad utility of the tool kit or kits. That is, the drivers are typically made from aluminum which is a softer metal that will not damage the hardened bearing races against which the drivers are to impinge. Further, the frustoconical portion of drivers for pinion bearing races is unique in that the angle subtended by the frustoconical walls of such drivers is in the range of about 40°, thus enabling such drivers to be used for pinion bearing races such as associated with the differential of a vehicle.

In a preferred embodiment, the pneumatic driver handle includes a forward annular face which engages against a washer or alternatively against a driver face. The face has an annular area about three times greater than the cross sectional area of the axial passage through the driver.

With a kit or kits of the invention, it is possible, therefore, to provide manual, as well as pneumatic, driving of bearing races and/or seals and to incorporate an extension for the manual handle driving mechanism. Multiple combinations of drivers and driver handles are, therefore, useful to enable universal or broad utility of the kit or kits to enable repair of almost any modern day vehicle or machine utilizing bearing races.

Thus, it is an object of the invention to provide an improved bearing race driver kit or set.

It is a further object of the invention to provide a bearing race driver kit which may include a manual handle and/or a pneumatic driving handle for driving a driver.

Another object of the invention is to provide manual handles and component parts of a driver kit which are manufactured from hardened or case hardened steel, by way of example, for use in cooperation with softer metal drivers such as aluminum metal drivers.

Another object of the invention is to provide an economic, yet highly rugged and efficient bearing race driver kit.

Another object of the invention is to provide a pinion bearing race driver kit or set incorporating unique drivers and various options for driving such drivers.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 7 is an end view of a washer incorporated as part of the kit of the invention;

FIG. 8 is an isometric view illustrating the manner of usage of the tool of the invention using the manual handle;

FIG. 9 is an isometric view similar to FIG. 8 wherein the manual handle includes an extension handle associated therewith;

DESCRIPTION OF THE PREFERRED EMBODIMENT

Figure 1:
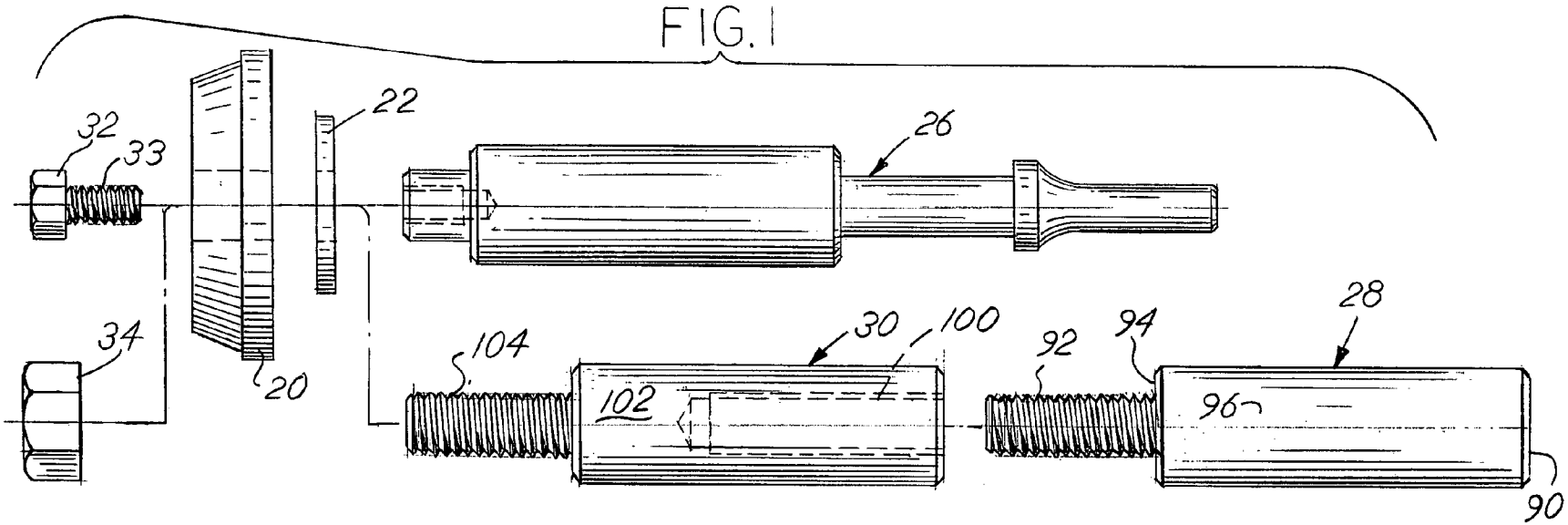
FIG. 1 is a side elevation of various component parts that may be included in a kit of the invention including the various types of driver handles.

The race and seal driving kits or sets of the invention are comprised of a series of component parts which are typically maintained in a kit carrier package or container. The component parts may be mixed, matched and assembled in order to accomplish the appropriate task of sizing the driver for use with respect to the unique size of the pinion race, bearing race or seal involved to drive the race or seal appropriately either manually or pneumatically. Thus, a kit typically includes a series of race and seal drivers 20 which are typically manufactured from aluminum and have the form of a shaped disc as described in greater detail hereinafter. The drivers 20 generally cooperate with a hardened steel washer 22 which is aligned coaxially along an assembly axis 24 for the tool. A pneumatic driver handle 26 may be used in combination with any one of the race and seal drivers 20. Alternatively, a manual handle 28 or a manual handle 28 with an extension or extender handle 30 may be used in combination with a driver 20. Depending upon the particular driver handle (26 or 28) that is being utilized, either a bolt 32 or a nut 34 is used to attach the component parts; namely, the driver 20, washer 22 and one of the handles 26, 28 or 30 together. Thus bolt 32 is used to connect to the pneumatic handle 26 to driver 20. Nut 34 may be used to connect to the handle 28 or the extension handle 30 to a driver 20.

The component parts described are generally symmetrical about the elongate axis 24. The parts described are generally cylindrical with various angular side surfaces to facilitate their use and interaction.

Figure 2:
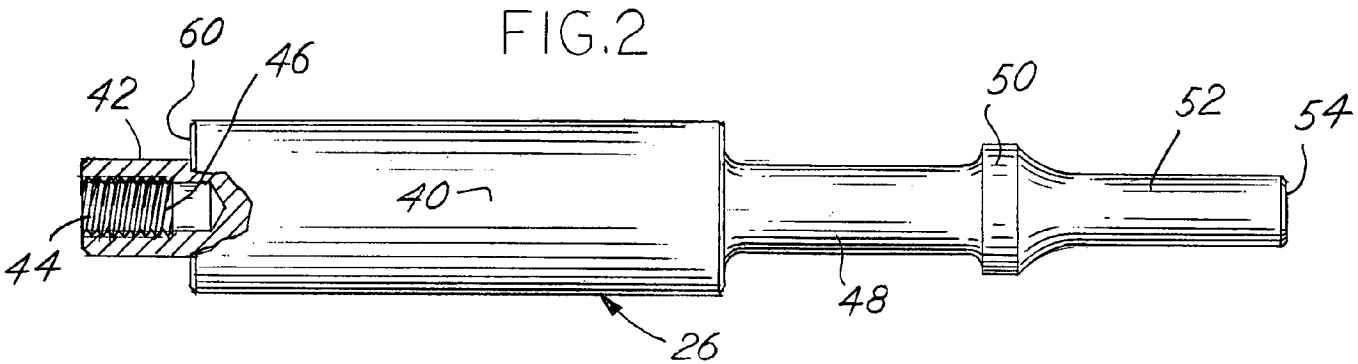
FIG. 2 is a side elevation of the pneumatic driver handle depicted in FIG. 1.

FIG. 2 illustrates the pneumatic driver handle 26. The pneumatic driver handle 26 is preferably made from an alloy steel such as 41L40 steel tempered to a hardness of RC 46-50. The pneumatic driver handle 26 is comprised of a forward cylindrical section 40 with a projecting coaxial stud 42 that includes internal threads 44 in a counterbore 46. The threaded counterbore 46 is designed to receive the threaded shaft 33 of bolt 32 and thereby retain driver 20 and washer 22 on the stud 42. Projecting from the back side of forward section 40 is a connecting rod 48 with a peripheral or circumferential rim 50 connected with a next adjacent drive rod section 52 having a distal end face 54. The described component parts are coaxial and the drive rod section 52 is adapted to receive a pneumatic driving tool. The pneumatic driver handle 26 includes an annular rim with a face or surface 60 surrounding the stud 42. As an important feature of the invention, the area of the surface 60 is about three times greater than the cross sectional area of a passage 74 in driver 20. Thus, when the hard metal face 60 of the pneumatic driver tool 26 is inserted against a back side face of a race and seal driver 20, the load or force thereon will be appropriately spread or apportioned so as to avoid adversely affecting the softer metal, i.e. aluminum driver 20. As an alternative or in addition to properly sizing the surface 60, washer 22 may be inserted over the stud 42 to spread the load on the surface of the driver 20. The washer 22 is thus typically an important component of the kit. It is noted that the washer 22 is typically a case hardened steel material.

Figure 3:
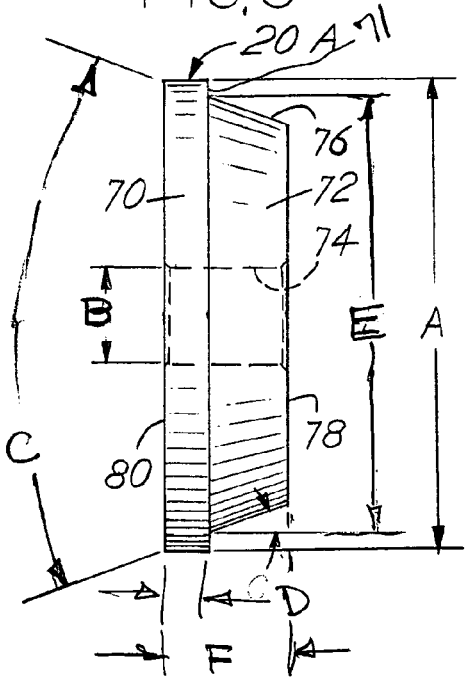
FIG. 3 is a side view of a typical driver.
Figure 4:
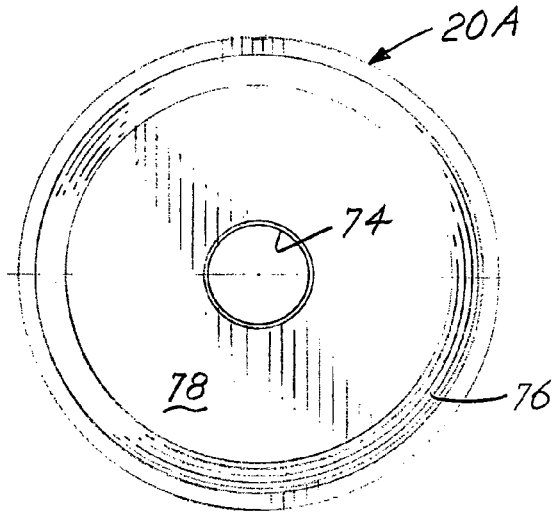
FIG. 4 is an end view of the driver of FIG. 3.
Figure 5:
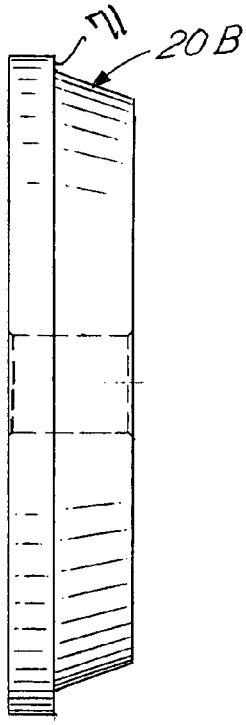
FIG. 5 is a side view of a distinctly sized driver relative to the driver of FIG. 3.
Figure 6:
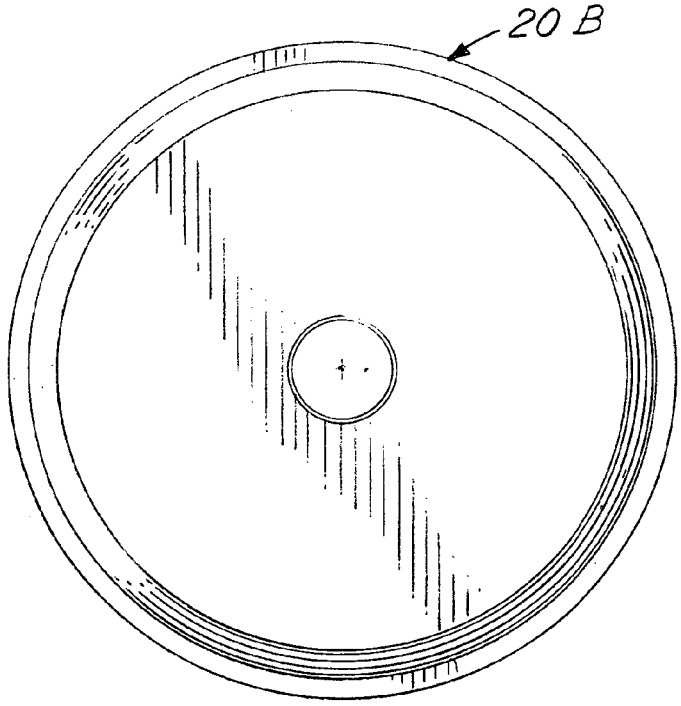
FIG. 6 is an end view of the driver of FIG. 5.

FIGS. 3, 4, 5 and 6 depict two typical drivers. Referring to FIG. 3, the driver 20A includes a generally cylindrical collar 70 with an axial dimension D. Collar 70 is joined to a axial, frustoconical disc 72 by a radially extending annular surface 71. A center throughpassage 74 is coaxial with the generally cylindrical collar 70. Each driver 20, such as the driver 20A of FIG. 3 and the driver 20 B of FIG. 5, is uniquely sized. Thus, the radial dimensions of the drivers 20A and 20B and other dimensions comprise unique sizing as set forth by way of examples in Table 1 and Table 2.

The frustoconical forward section 72 includes a frustoconical surface 76 which defines a subtended angle of about 40°±10°, preferably in the range of about 40±2°. The angle of approximately 40° is important, particularly when drivers 20 are used in association with pinion bearing races. Of course, drivers 20 of a design having a different angle subtended by the frustoconical surface 76 may be utilized in the combination for non-pinion bearing races. Common angles associated with such drivers for non-pinion bearing races and seals are in the range an angle of about 20°-30° subtended by the surface 76. As currently practiced, the larger subtended angle of about 40° is important particularly with certain applications such as pinion bearing races. Thus, a pinion bearing race kit preferably includes drivers 20 having such a subtended angle of about 40° associated therewith.

Each of the drivers 20, such as shown in FIGS. 3, 4, 5 and 6 includes a forward facing surface 76 and a rear surface 80. The rear surface 80 is typically engaged by a washer 22 as previously described. As explained, each of the drivers 20 depicted in the separate FIGS. 3, 4, 5 and 6 have different radii and other unique dimensional features. However, the angles subtended by the frustoconical surface 76 for pinion bearing race applications is generally the same; namely about 40°. For non-pinion bearing races the subtended angle is generally in the range of 20°-30°.

In use, the manual handle; namely, the handle 28, may be attached to a driver 20 such as shown in FIG. 8. Thus, a manual handle 28 includes an impact end 90, a threaded forward stud or surface 92, an annular impact surface 94 and a cylindrical body 96. The manual handle 28 and extension 30 are generally useful for pinion bearing race repair or installation to improve accessibility for the driver. The manual handle 28 and extension 30 are typically fabricated from aluminum.

In operation, as depicted in FIG. 8, the threaded end 92 or stud 92 may be fitted through the driver 20 and retained thereon by means of nut 34. In operation, a repairman drives the handle 28 with a hammer, for example, as depicted in FIG. 8 in order to drive a race bearing seal or the like.

As depicted in FIG. 9, extender handle 30 includes a counterbore 100 which is threaded for receipt of the threaded stud 92 of the handle 28. The extension or extender handle 30 is a generally cylindrical member having a cylindrical body 102 and a forwardly extending threaded stud or stud 104 adapted to cooperate with and engage the nut 34. Thus, the handle 28 may be threaded to the extender handle 30 and the extender handle 30 fitted to a driver 20 and attached thereto by means of the nut 34. FIG. 9 depicts the manner of usage of the driver 20 with the extender handle 30 incorporated therewith. Typically stud 92 is identical dimensionally to stud 104.

Figure 10:
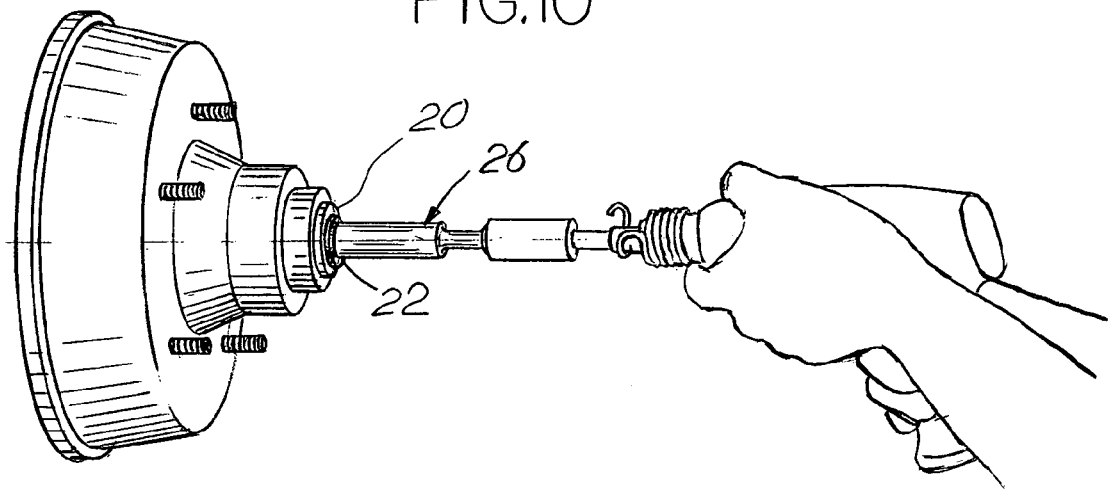
FIG. 10 is an isometric view of the bearing race driver of the invention in combination with a pneumatic handle.

FIG. 10 depicts the utilization of a driver 20 in combination with the pneumatic handle 26. Thus, the pneumatic handle 26 is either directly attached to the driver 20 or in combination with the washer 22. A bolt 32 as previously described holds the driver 20 in contact with the pneumatic driver handle 26. As depicted in FIG. 10 the pneumatic driver handle 26 may then be engaged and driven by a pneumatic tool.

Figure 11:
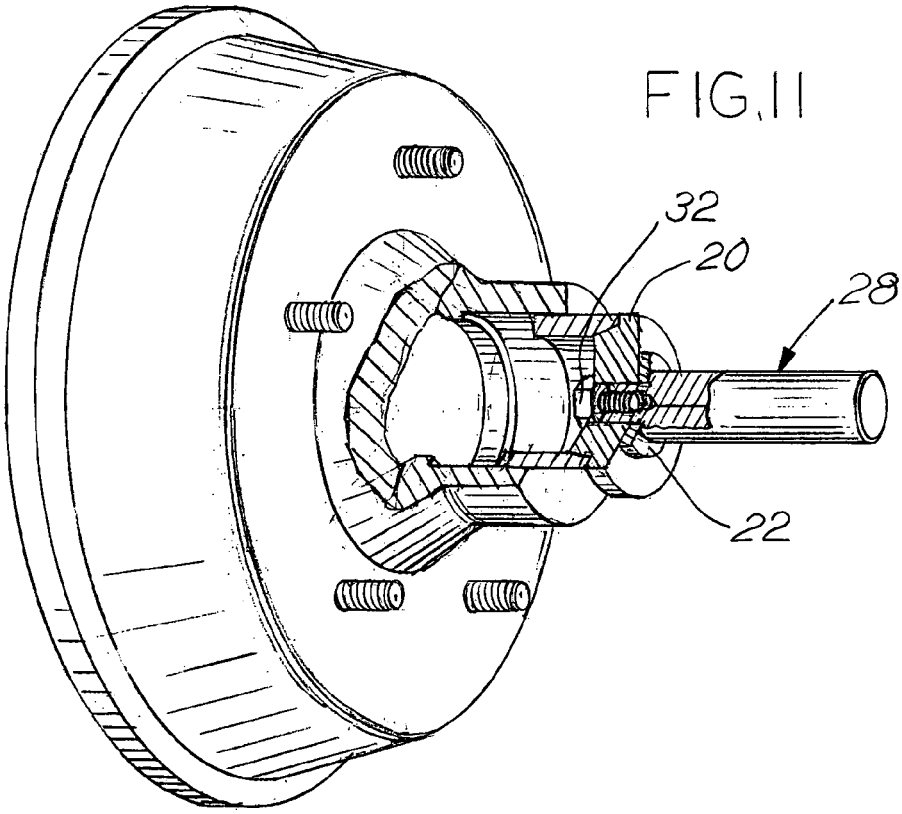
FIG. 11 is a cut away cross sectional view illustrating the manner in which the driver of the invention in combination with various handles may be utilized to drive a bearing race into position.

FIG. 11 is a cross sectional view of the driver 20 in combination with various types of manual 28, 30 handles to effect removal or replacement of a bearing race. Thus, various handle elements may be combined with a driver 20 in order to effect bearing race removal or replacement.

A typical kit for bearing races may include the following drivers (see FIG. 4) and handles having the following described dimensional characteristics as set forth in Table 1:

TABLE 1

| Driver | Dimensions | $A^{(in)}$ | $B^{(in)}$ | $C^{(°)}$ | $D^{(in)}$ | $E^{(in)}$ | $F^{(in)}$ |
|---|---|---|---|---|---|---|---|
| 1 | 1.565 | 1.563 | .565 | 21° | .25 | 1.413 | .569 |
| 2 | 1.750 | 1.740 | .562 | 21° | .25 | 1.573 | .569 |
| 3 | 1.965 | 1.963 | .562 | 21° | .25 | 1.762 | .569 |
| 4 | 2.325 | 2.325 | .562 | 30° | .25 | 2.122 | .687 |
| 5 | 2.470 | 2.473 | .562 | 30° | .25 | 2.312 | .687 |
| 6 | 2.555 | 2.553 | .562 | 30° | .25 | 2.352 | .687 |
| 7 | 2.830 | 2.830 | .562 | 26° | .25 | 2.670 | .685 |
| 8 | 2.995 | 2.995 | .562 | 30° | .25 | 2.840 | .685 |
| 9 | 3.180 | 3.180 | .562 | 25° | .25 | 2.980 | .685 |
| 10 | 3.805 | 3.800 | .562 | 30° | .25 | 3.535 | .685 |
| 11 | 4.604 | 4.604 | .562 | 32° | .25 | 4.333 | .688 |

A typical kit for pinion races will have the following dimensional characteristics:

TABLE 2

| Driver No. | Dimensions | $A^{(inches)}$ | $B^{(inches)}$ | C | $D^{(in)}$ | $E^{(in)}$ | $F^{(in)}$ |
|---|---|---|---|---|---|---|---|
| 1 | | 2.658 | 0.569 | 40° | .25 | 2.488 | .688 |
| 2 | | 2.823 | 0.562 | 40° | .25 | 2.648 | .688 |
| 3 | | 2.844 | 0.562 | 40° | .25 | 2.663 | .688 |
| 4 | | 2.970 | 0.562 | 40° | .25 | 2.788 | .688 |
| 5 | | 3.220 | 0.562 | 40° | .25 | 3.040 | .688 |
| 6 | | 3.470 | 0.562 | 40° | .25 | 3.258 | .688 |
| 7 | | 3.720 | 0.562 | 40° | .25 | 3.528 | .688 |
| 8 | | 4.095 | 0.562 | 36° | .25 | 3.892 | .688 |

It may be possible to combine kits represented by Tables 1 and 2; however, such combinations would not be typical. Also, kits for non-automotive purposes may be created using the parts and concepts disclosed, but customized dimensionally.

The general construction and operation of the tool thus enables the tool to comprise a useful item for vehicle repair. Other uses other than vehicle repair wherein race bearings are involved render the tool even more universal. Variations of the tool may be effected without departing from the spirit and scope of the invention. The invention is therefore to be limited only by the following claims and equivalents thereof.

What is claimed is:

1. A kit for installation of bearing races, said races having an exterior wall surface, a frustoconically tapered interior wall surface, and a circumferential exterior surface, said kit comprising, in combination:

at least two uniquely sized drivers, each driver comprising a generally cylindrical collar coaxially joined with a frustoconical disc have a maximum diameter less than the diameter of the collar, each driver including an axial passage and an annular flange surface joining the frustoconical disc to the collar;

a universal manual, generally cylindrical driver handle comprised of a rod with an axially projecting, threaded stud at one and, a generally transverse driver face at the opposite end and an annular flange surface surrounding the stud;

a washer with an axial passage sized to fit over the threaded stud and against the driver annular flange surface between the driver handle flange surface and a driver;

a first fastener for attachment to the stud to snug the handle against the washer and driver;

an alternate pneumatic driver handle including a forward generally cylindrical section with a projecting coaxial stud having a coaxial thread, said pneumatic driver handle further including an annular rim surface surrounding the coaxial stud of said driver handle and further including a coaxial driving end comprising a coaxial drive rod for engagement by a pneumatic tool, said with a distal end, a peripheral collar intermediate the distal end of the drive rod and the forward cylindrical section for engagement by a pneumatic tool; and a second fastener for coaxial attachment to the pneumatic driver handle stud to retain a driver on the driver handle stud.

2. The kit of claim 1 wherein the annular rim surface of the pneumatic driver has an area about three times greater than the cross sectional area of the stud.

3. The kit of claim 1 wherein the drivers are aluminum, the manual handle is aluminum and the pneumatic handle is hardened steel.

4. The kit of claim 1 wherein the washer is hardened steel.

5. The kit of claim 1 further including an axially extending manual extension handle comprising a generally cylindrical rod with a driver end and a driving end, the driven end including an axial counterbore for receipt of the threaded stud of the manual handle and the driving end including a threaded coaxial stud for fitting through an axial passage of a driver and attachment to the first fastener.

6. The kit of claim 5 wherein the threaded studs of the manual extension handle and manual handle are substantially identical.

7. The kit of claim 1 wherein the frustoconical wall of at least two drivers converges to a subtended angle of about 40°±10°.

8. The kit of claim 7 wherein the frustoconical wall of at least two drivers converge to a subtended angle of about 40°±2°.

9. The kit of claim 8 including at least five drivers having different diameter collars.

10. The kit of claim 1 wherein the threaded stud of the manual handle is externally threaded and the first fastener is a nut.

11. The kit of claim 1 wherein the threaded stud of the pneumatic driver handle is an internally threaded counterbore and the second fastener is a threaded bolt.

12. The kit of claim 1 wherein the frustoconical wall of at least two drivers converges to a subtended angle of about 20°±10°.

13. The kit of claim 1 wherein the threaded stud of the manual handle is externally threaded and the first fastener is a nut; and wherein the threaded stud of the pneumatic driver handle is an internally threaded counterbore and the second fastener is a threaded bolt.

14. The kit of claim 13 wherein the threaded studs of the manual handle and manual extension handle are substantially identical.

15. A kit for installing bearing races each race including an exterior wall surface, a frustoconically tapered interior wall surface having a lesser major diameter than the exterior wall diameter, and a circumferential exterior surface connecting the frustoconical surface and exterior wall surface, said kit comprising, in combination:

at least two uniquely sized drivers, each driver comprising a generally cylindrical collar coaxially joined with a frustoconical disc, each driver including an axial passage and an annular flange surface extending radially outward from the frustoconical disc to the cylindrical collar;

a universal manual, generally cylindrical driver handle comprised of a rod with an axially projecting, threaded stud at one end, a generally transverse driver face at the opposite end and an annular flange surface surrounding the stud;

a first fastener for attachment to the stud to snug the handle against the washer and driver;

an axially extending manual extension handle comprising a generally cylindrical rod with a driver end and a driving end, the driven end including an axial counterbore for receipt of threaded stud of the manual handle and the driving end including a threaded coaxial stud for fitting through an axial passage of a driver and attachment to the first fastener;

an alternate pneumatic driver handle including a forward generally cylindrical section with a projecting coaxial stud having coaxial thread, said pneumatic driver handle further including an annular rim surface surrounding the coaxial stud of said driver handle and further including a coaxial driving end comprising a coaxial drive rod, with a distal end, a peripheral collar intermediate the distal end of the drive rod and the forward cylindrical section for engagement by a pneumatic tool; and a second fastener for coaxial attachment to the pneumatic driver handle stud to retain said driver on the driver handle stud.

16. The kit of claim 15 wherein the threaded stud of the manual handle is externally threaded and the first fastener is a nut.

17. The kit of claim 15 wherein the threaded stud of the pneumatic driver handle is an internally threaded counterbore and the second fastener is a threaded bolt.

* * * * *

UNITED STATES PATENT AND TRADEMARK OFFICE

CERTIFICATE OF CORRECTION

PATENT NO. : 7,707,709 B2
APPLICATION NO. : 11/294907
DATED : May 4, 2010
INVENTOR(S) : Whitehead It is certified that error appears in the above-identified patent and that said Letters Patent is hereby corrected as shown below:

Claim 15, column 8, line 5
Please delete "washer and"

Signed and Sealed this

Fifth Day of October, 2010

David J. Kappos

David J. Kappos
*Director of the United States Patent and Trademark Office*